United States Patent [19]

Savard, Jr.

[11] 4,080,928

[45] Mar. 28, 1978

[54] APPARATUS FOR APPLYING AND ADHERING PARTICULATE THERMOPLASTIC MATERIALS TO SUPPORTING SUBSTRATES

[75] Inventor: Hassel J. Savard, Jr., Neshanic, N.J.

[73] Assignee: Atron, Inc., Rahway, N.J.

[21] Appl. No.: 717,882

[22] Filed: Aug. 26, 1976

[51] Int. Cl.[2] ..... B05C 13/00; B05C 19/00

[52] U.S. Cl. ..... 118/59; 118/308; 156/279; 156/289; 198/774; 427/195; 427/345

[58] Field of Search ..... 118/59, 308, 310, 311, 118/312; 198/774; 427/195, 345; 156/279, 289

[56] References Cited

U.S. PATENT DOCUMENTS

| | | | |
|---|---|---|---|
| 1,441,042 | 1/1923 | Thackray | 198/774 |
| 2,264,499 | 12/1941 | Bair | 118/308 X |
| 2,681,637 | 6/1954 | Simpson | 118/308 |
| 2,906,240 | 9/1959 | Gladwell | 118/59 X |
| 3,069,284 | 12/1962 | Berndt | 118/308 X |
| 3,139,371 | 6/1964 | Sisko | 156/279 X |
| 3,221,870 | 12/1965 | Pagay | 198/774 |
| 3,756,888 | 9/1973 | Kuroda | 156/289 X |

*Primary Examiner*—James Kee Chi
*Attorney, Agent, or Firm*—Alexander T. Kardos

[57] ABSTRACT

Methods and apparatus for applying and adhering particulate thermoplastic materials to supporting substrates, such as medallions, appliques, patches, and like goods which comprise: placing the goods on a relatively stationary support at a loading station thereof; lifting the goods from the relatively stationary support, moving them forwardly and replacing the goods on the relatively stationary support at a particulate thermoplastic materials applying station thereof; applying particulate thermoplastic materials to the surface of the goods; lifting the goods from the relatively stationary support, moving them forwardly and replacing the goods on the relatively stationary support at a heating and bonding station thereof; heating the particulate thermoplastic materials and adheringly bonding them to the surface of the goods; and disengaging or separating the goods with the adhered thermoplastic materials thereon from the relatively stationary support so that the goods are positioned forwardly beyond the heating and bonding station.

19 Claims, 14 Drawing Figures

APPARATUS FOR APPLYING AND ADHERING PARTICULATE THERMOPLASTIC MATERIALS TO SUPPORTING SUBSTRATES

THE FIELD OF THE PRESENT INVENTIVE CONCEPT

The present inventive concept relates to methods and apparatus for applying potentially activatable, thermoplastic adhesive materials in particulate form to supporting substrates, such as appliques, patches, medallions, insignia, monograms, logos, emblems, and like goods, and adhering the potentially activatable, particulate thermoplastic materials to said goods, whereby such goods can be subsequently reheated and reactivated and permanently adhered to cloths and fabrics of all types, including, for example, plastic sheets and films, leather goods, wood, paper, paper products, and like articles, such as blazers, sport coats and jackets; shirts, jerseys, shorts, jackets, and caps for tennis, golf, and other sports; uniforms; work and play clothes for decorative, ornamental or informative purposes, or utilitarian uses, such as patches for ripped or torn clothing and fabrics, etc.

THE GENERAL BACKGROUND OF THE PRESENT INVENTIVE CONCEPT

In the apparel, house furnishings, and related textile industries, there has been considerable interest shown in the coating of the reverse sides of supporting substrates, such as appliques, patches, medallions, insignia, monograms, logos, emblems, and like goods of a relatively flat or planar nature with potentially activatable, particulate thermoplastic adhesive materials, and adhering or bonding the paticulate thermoplastic materials to the reverse sides of such goods, whereby they can be subsequently reheated and reactivated and easily and more or less permanently adhered to cloths and fabrics of all types, plastic sheets and films, leather goods, wood, paper, paper products, release paper, and like articles.

Machines and processes have been previously devised for accomplishing such purposes and objects but have been relatively costly with regard to the machines or apparatus required, inefficient and uneconomical with regard to the usage of the particulate thermoplastic materials employed, and time-consuming and slow with regard to desirably high productivity rates.

PURPOSES AND OBJECTS OF THE PRESENT INVENTIVE CONCEPT

It is therefore a principal purpose and object of the present inventive concept to provide methods and apparatus for applying and permanently adhering particulate thermoplastic materials to goods such as appliques, patches, medallions, insignia, monograms, logos, emblems, and the like, wherein the apparatus is not as costly or as expensive as prior art apparatus, the particulate thermoplastic materials are used more efficiently and more economically and with less waste, and the operating and productivity rates are relatively high.

BRIEF SUMMARY OF THE PRESENT INVENTIVE CONCEPT

It has been found that such principal purposes and objects, as well as other principal purposes and objects which will become clear from a further reading and understanding of this specification, can be attained by providing methods and apparatus for applying and adhering particulate thermoplastic materials to appliques, patches, medallions, insignia, monograms, logos, emblems, and like goods which comprise: placing the goods on a relatively stationary support at a loading station thereof; lifting the goods from the relatively stationary support, moving them forwardly, and replacing the goods on the relatively stationary support at a particulate thermoplastic materials applying station thereof; applying particulate thermoplastic materials to the surface of the goods; lifting the goods with the applied particulate thermoplastic materials thereon from the relatively stationary support, moving them forwardly, and replacing the goods on the relatively stationary support at a heating and bonding station thereof; heating the particulate thermoplastic materials and adheringly bonding them to the surface of the goods; and disengaging or separating the goods with the adhered thermoplastic materials thereon from the relatively stationary support so that the goods are positioned forwardly beyond the heating and bonding station.

BRIEF DESCRIPTION OF THE DRAWINGS

In the following specification and accompanying self-explanatory drawings, there are described and illustrated preferred and typical embodiments of the present inventive concept but it is to be appreciated that the present inventive concept is not to be construed as limited to such preferred or typical embodiments which are illustrative but not limitative of the broader aspects and scope of the present inventive concept.

Referring to the drawings.

DESCRIPTION OF THE PREFERRED EMBODIMENT

Figure 1:
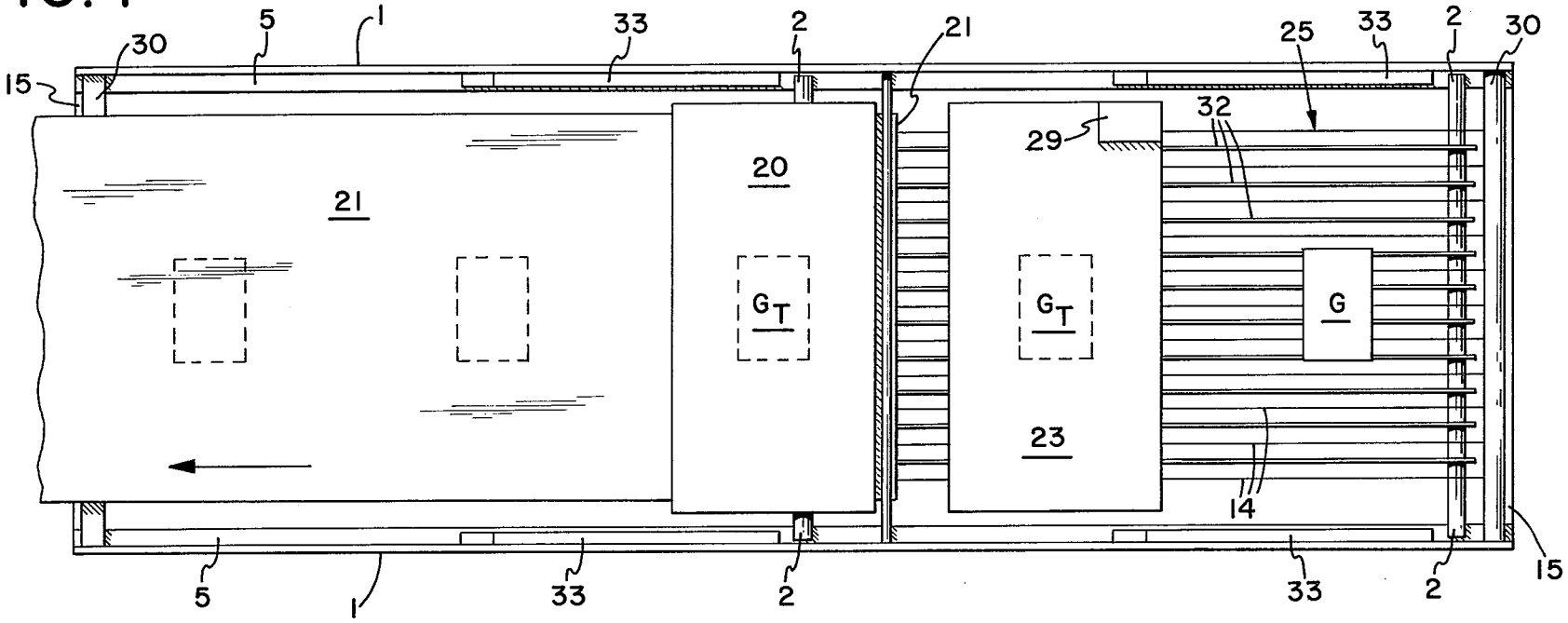
FIG. 1 is a simplified, schematic, diagrammatic drawing, showing in plan view a typical and preferred embodiment of process and apparatus suitable for carrying out the general and specific principles of the present inventive concept.
Figure 2:
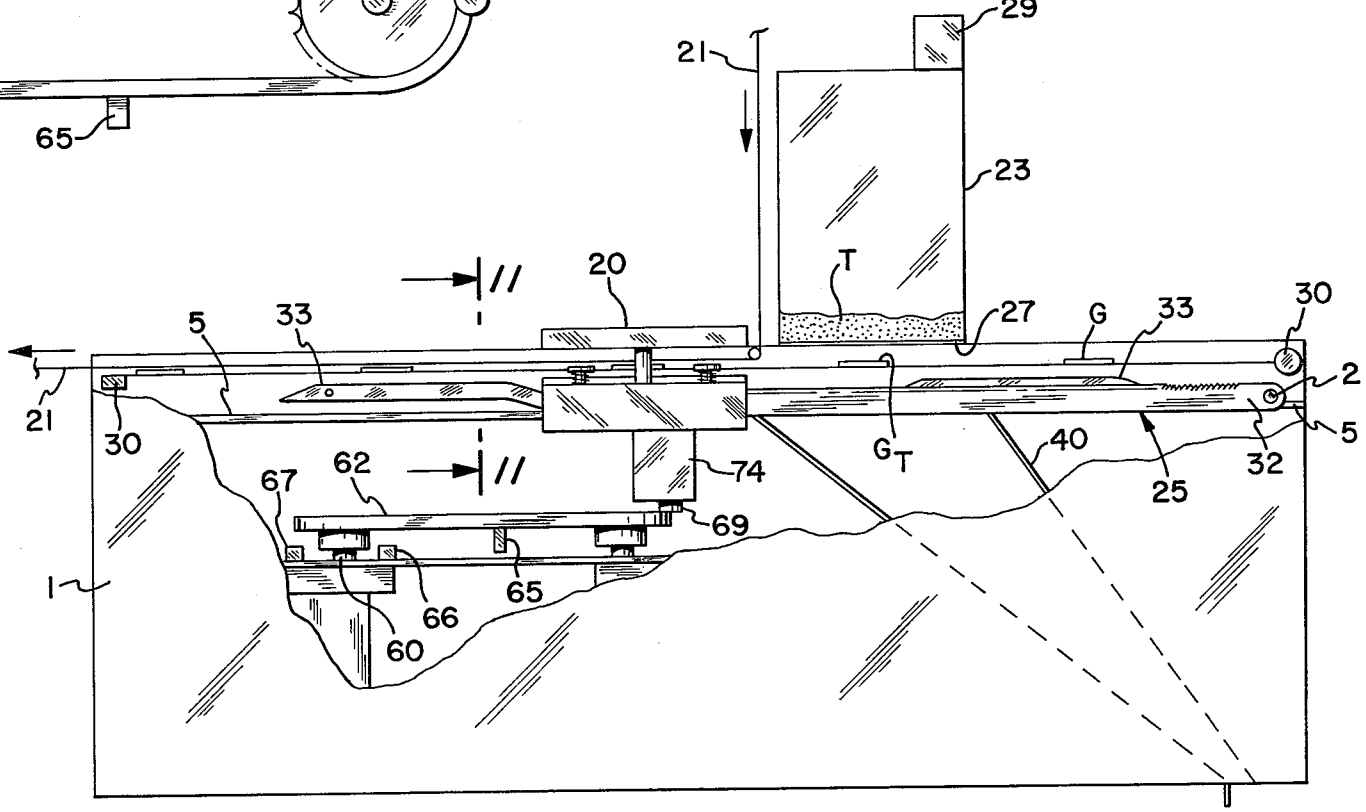
FIG. 2 is a simplified, schematic, diagrammatic drawing, partially cutaway, showing in elevation the embodiment of the present inventive concept illustrated in FIG. 1.

With specific reference to FIGS. 1 and 2 of the drawings, there is shown a pair of side frames or plates 1, 1 which provide the basic side structure for the apparatus. A pair of reinforcing stringer bars 15, 15 extend transversely between the side frames 1, 1 at or near the ends thereof and establish the width of the apparatus. A plurality of relatively stationary supporting members 14, such as wires or relatively thin rods, extend for substantially the full length of the apparatus between the transversely-extending stringer bars 15, 15. Wires of small diameter are preferred as the supporting members 14 for reasons which will become clearer from a further reading and understanding of this specification. The support wires 14 are substantially parallel, are equally spaced from one another, and are sufficiently closely spaced as to be capable of supporting thereon small flat articles G such as medallions, appliques, patches, and the like, without permitting them to slip and fall downwardly through the individual support wires 14. Wire anchor bars 30, 30 are provided immediately adjacent the stringer bars 15, 15 to facilitate the anchoring of the support wires 14 in their desired spaced, parallel relationship.

THE SHUTTLE ASSEMBLY

Figure 11:
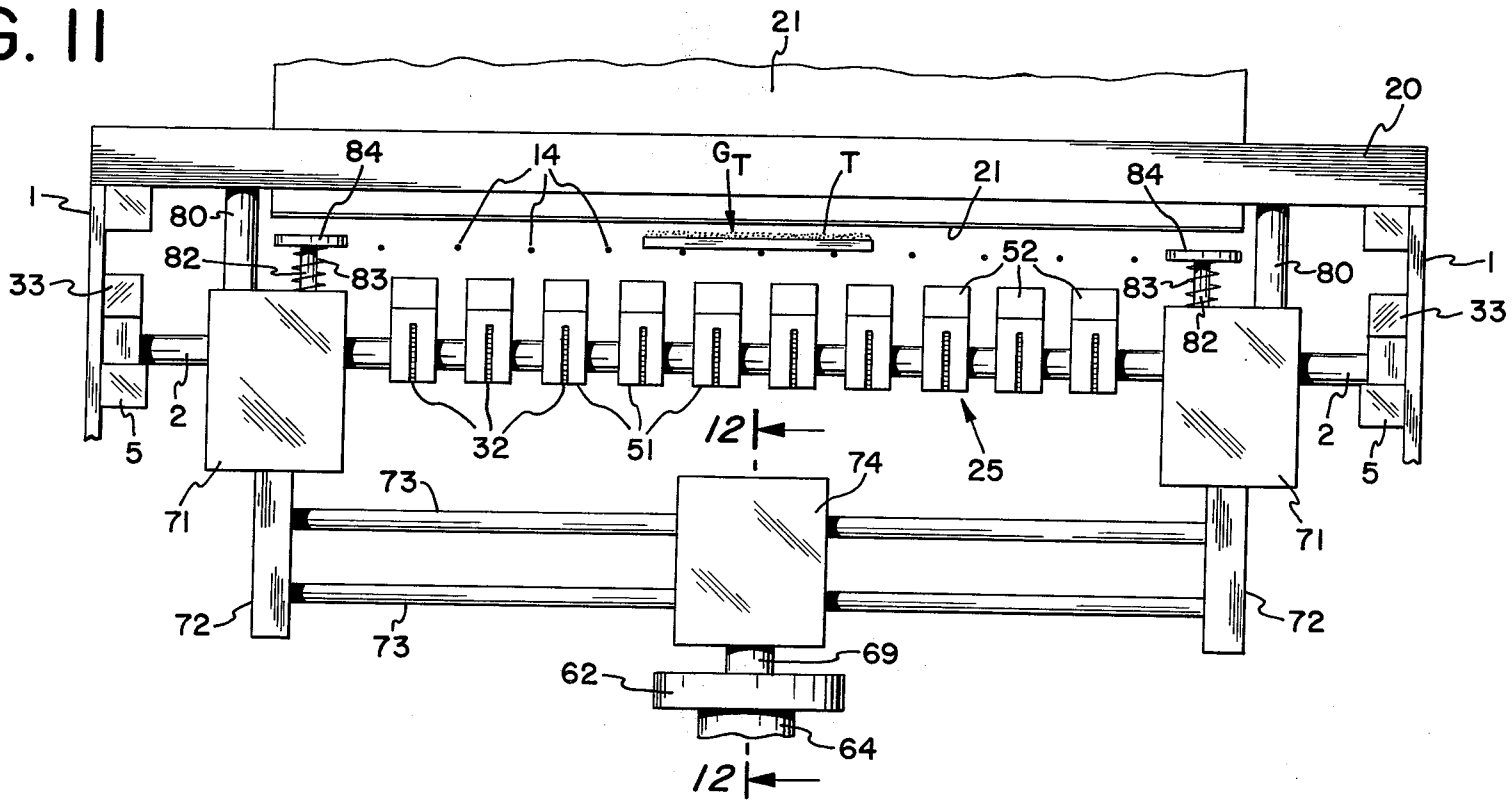
FIG. 11 is a fragmentary, cross-sectional view in elevation, with some parts omitted fro purposes of clarity of illustration, taken on line 11—11 of FIG. 1, looking in the direction of the arrows 11, 11.

A shuttle assembly 25 is employed to intermittantly advance the medallions, appliques, patches, or like goods G individually by step-by-step stages through the apparatus and comprises a pair of spaced, substantially cylindrically shaped cam followers 2, 2 which extend transversely across the full width of the apparatus and are adapted to have their ends slide along a pair of lower rails 5, 5 secured to the inside walls of the side frames or plates 1, 1 (See FIG. 11).

A plurality of movable, lifting and transporting members 32 are mounted on and connect the cam followers 2, 2 and are employed to intermittantly lift the goods G from the support wires 14 and to advance them in stepwise stages a predetermined distance individually through a considerable portion of the length of the apparatus. The lifting and transporting members 32 may comprises wires, or relatively thin rods, or vertically positioned slats, and are positioned between the support wires 14, as best shown in FIG. 1.

Figure 6:
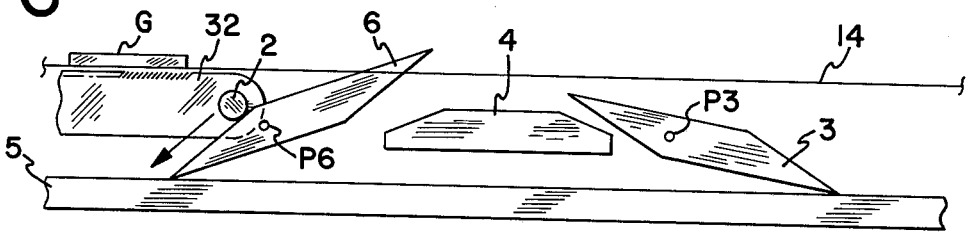

The upper or top surfaces or edges of the lifting and transporting members 32 are preferably serrated or are otherwise roughened and thus may resemble the working operative edges of saw blades, which actually is one specific embodiment of the lifting and transporting members 32, as shown in FIGS. 2 and 6. Smooth top edges or surfaces, however, are also of use.

Figure 3:
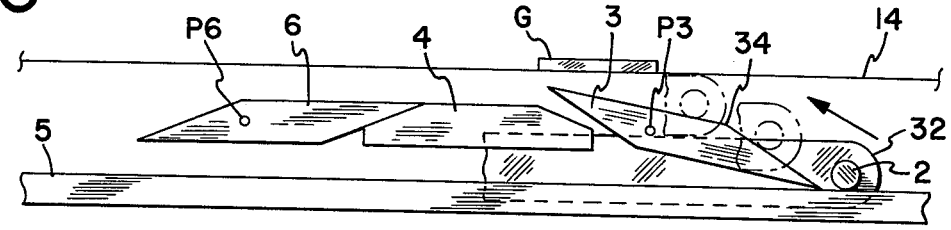
FIG. 3 is a simplified, schematic, fragmentary, diagrammatic drawing, with some parts omitted for purposes of clarity of illustration, showing the initial positions of a shuttle assembly for lifting the goods, moving the goods forwardly, and then replacing the goods at a predetermined advanced position on the support wires.
Figure 4:
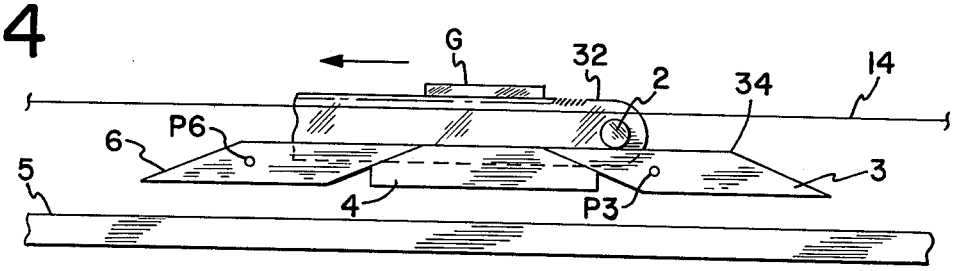
FIGS. 4–8 are simplified, schematic, fragmentary, diagrammatic drawings, similar to FIG. 3, but showing additional positions of the shuttle assembly during its cyclic operation.
Figure 5:
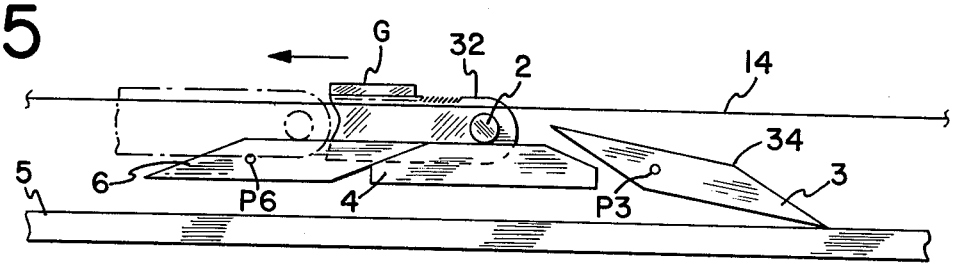
Figure 7:
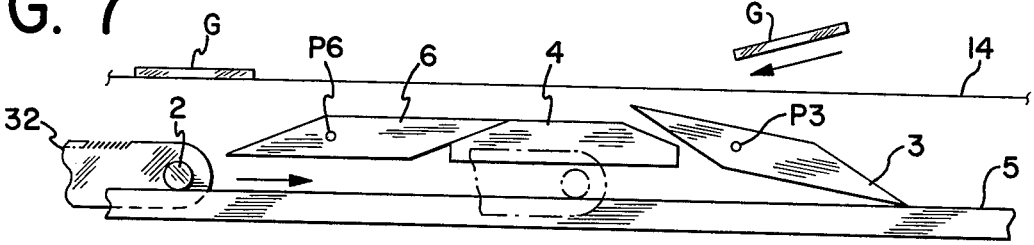

The shuttle assembly 25 which thus primarily comprises the two spaced cam followers 2, 2 and the plurality of connecting lifting and transporting members 32 extending therebetween (and other parts to be described in greater detail hereinafter) is intermittantly actuated by a conventional intermittantly operable electric motor (not shown) and a suitable cyclic reversing mechanism to advance from a rearmost position, as shown in FIGS. 1–3 to a forwardmost position, as shown in FIG. 7, and then to return to the rearmost position of FIGS. 1–3, and then to keep repeating such a cycle, which will be described in greater particularity in FIGS. 3–8 which represent a modification of the cam portion of the present invention which is different mechanically but not procedurally from the cam portion prepresented in FIGS. 1 and 2.

THE ELEVATING AND LOWERING CAMS

In FIG. 3, the cam followers 2, 2 riding on the lower rails 5, 5 are driven forwardly or to the left to successive positions, as shown in FIG. 3, wherein the cam followers 2, 2 and their associated lifting and transporting members 32 are moved upwardly whereby goods G which were previously manually positioned (as shown in FIG. 3) by an operator, or by an automatic feeding and loading device, are picked up and lifted from the support wires 14 by the lifting and transporting members 32. This is accomplished by the cam followers 2, 2 riding up off the lower rails 5, 5 and onto the upwardly slanting surfaces of a pair of elevating or "up" cams or dogs 3, 3, a pair located on each side of the apparatus. The sharpness or the angularity of the upward rise of the sam followers 2, 2 decreases after the cam followers 2, 2 pass the corner or point 34 (see FIG. 3) and subsequently actually becomes horizontal in direction after the cam followers 2, 2 pass the pivot point P3 of the "up" cam 3 (see FIG. 4) which causes the cam 3 to tilt, as shown. By this time, the lifting and transporting members 32 have lifted the goods G from the relatively stationary support wires 14 and are moving them forwardly, or to the left.

The cam followers 2, 2 continue to move horizontally, or to the left; move over a fixed horizontal elevated rail 4; and move onto the horizontal portion of a lowering or "down" cam or dog 6. When the cam followers 2, 2 pass the pivot point P6 of the "down" cam 6, the cam 6 tilts and rotates to assume the position shown in FIG. 6. The cam followers 2, 2 are then lowered to finally reach the lower rails 5, 5, as shown in FIG. 7. By this time, the goods G have been advanced the full length of their individual step-by-step forward movement and are replaced on the stationary support wires 14.

Figure 8:
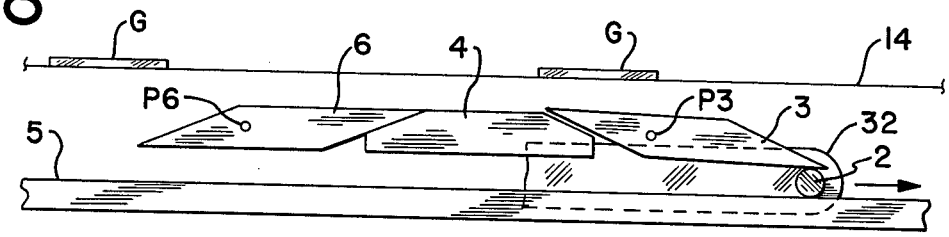

The shuttle carrier 25 is then automatically returned rearwardly, or to the right, passing under and temporarily tilting the "up" cam, as shown in FIG. 8, to ultimately return to the rearmost position of FIG. 3 and thus is ready for the beginning of the next cycle.

THE ONE-PIECE ELEVATING AND LOWERING CAMS

In FIGS. 3–8, there has been illustrated an elevating cam 3, an elevated rail 4, and a lowering cam 6 to provide for the up, horizontal, down, and return movements of the cam followers 2, 2.

Figure 9:
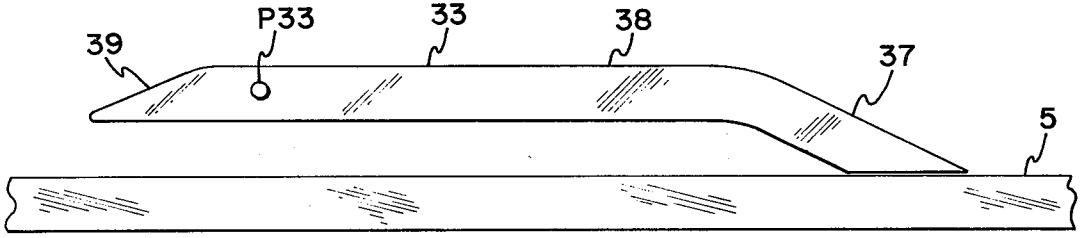
FIG. 9 is a detail drawing, showing an integral, combined elevating and lowering cam or dog.
Figure 14:
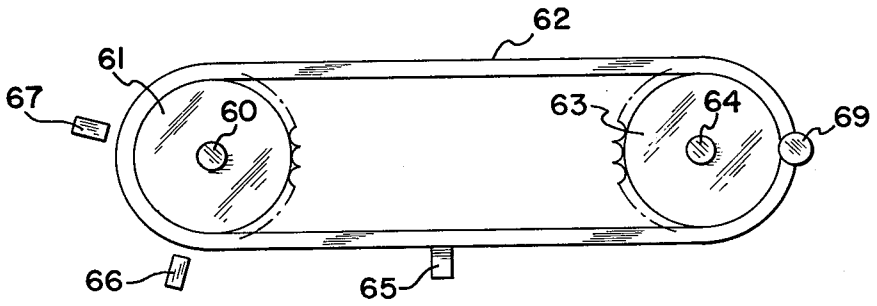
FIG. 14 is a fragmentary, detail plan view, with some parts omitted for purposes of clarity of illustration, showing details of the driving and reversing cyclic mechanism for the shuttle assembly.

In FIGS. 1, 2 and 9, there is illustrated a simpler form of such a movement-controlling device. A pair of integral, one-piece elevating and lowering cams 33, 33 are shown, a pair on each side plate 1, having an elevating cam surface 37, a horizontal sliding surface 38, a lowering cam surface 39, and a single pivot point P33.

Figure 10:
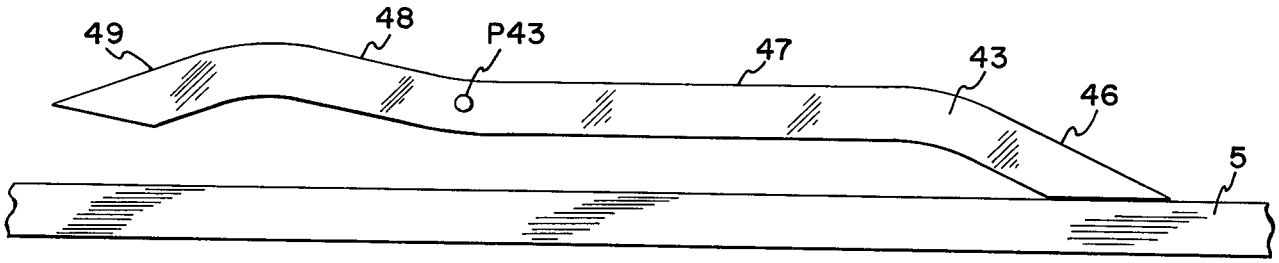
FIG. 10 is a detail drawing, showing another integral, combined elevating and lowering cam or dog.

The operation of cam 33 is somewhat generally similar to the operation of cam 3. The cam followers 2, 2 slide along the side rails 5, 5, move upwardly along the slanting cam surface 37, then horizontally along the horizontal elevated surface 38, then tip or tilt the cam 33 after they pass the pivot point P33, and finally slide downwardly on the inclined cam surface 39 to return to the rails 5, 5. Return movement of the cam followers 2, 2 is rearwardly along the side rails 5, 5 and under the right hand end of the cam 33 which tips or tilts counterclockwise to permit the cam follower 33 to pass thereunder to return to the original initial starting point, ready for the beginning of the next cycle. In FIG. 10, there is illustrated another form of an integral, one-piece elevating and lowering cam 43 having an upwardly inclined cam surface 46 to raise the cam followers 2, 2, a horizontal guiding surface 47, a second surface 48 which initially is inclined upwardly but, after the cam followers 2, 2 pass the pivot point P43, tips or tilts and becomes a second horizontal guiding surface 48, and a downwardly inclined lowering cam surface 49 which contacts and rests on the lower rail 5 after the cam followers 2, 2, have tipped or tilted the cam 43. Return movement of the cam followers 2, 2 is along the surface of the lower rail 5 to the right and under the "up" portion of the cam surface 46 which tilts upwardly temporarily to permit the cam followers 2, 2 to return to their original initial starting point, ready for the beginning of the next cycle.

It is to be appreciated that the cam surface 48, although initially inclined upwardly as shown in FIG. 10 at a relatively small angle, say, between about 7° and about 12°, becomes horizontally disposed when the cam 43 tips or tilts, due to the action of the cam followers 2, 2 passing the pivot point P43. The extent of the tipping or tilting of the cam 43 is also in the same range, that is, from about 7° to about 12°.

It is to be observed that the various pivot points P3, P6, P33 and P43 are not located at the centers of gravity of their respective cams but are actually positioned away from such centers of gravity, so that the respective cams will naturally tend to rotate, due to the force of gravity, and fall to the positions indicated in FIGS. 3, 9 and 10. And, of course, the respective cams will tend to return to such illustrated positions, if they are tipped or tilted away from such positions. If desired, conventional and standard springs or other spring-loaded devices (not shown) may be employed to insure that the cams promptly and positively come to the desired positions, as shown in FIGS. 3, 9 and 10.

DRIVING MEANS

The cyclic forward up, horizontal and down movements and the rearwardly back movement of the cam followers 2, 2 and the associated shuttle carrier or assembly 25 is provided for by any suitable driving means and reversing-movement mechanism. As shown in FIGS. 2 and 11–14, a motor (not shown) drives a rotatable shaft 60 upon which is mounted a sprocket wheel 61. A sprocket chain 62 meshes with the sprocket wheel 61 and in turn drives a second sprocket wheel 63 mounted on a rotatable shaft 64.

Secured to the underside of the sprocket chain 62 is a depending detent or contact 65 which periodically and cyclically makes contact with electrical or other terminals 66 and 67 to actuate a vibrator 29, or any other mechanism at the proper moment, or to stop the operation of the apparatus temporarily completely, if a dwell or delay is desired or required at any specific time during the operation. Such a delay or dwell in the operating cycle is desirable in many instances, particularly when more time is desired or required for the heating, fusing, and bonding operation, due to the nature of the particulate thermoplastic materials or to the nature of the goods themselves, or for other reasons. In such a case, the terminal 67 is attached to a suitable, conventional time-delay device, which is well known in the art, which immediately cuts off and stops the movement of the sprocket wheel 61 and the sprocket chain 62, without cutting off or stopping the heating of the heating and bonding unit 20 and the heating and bonding of the particulate thermoplastic materials T. In other words, the heating unit 20 does not cool during the time delay.

The sprocket wheel 61 and the sprocket chain 62 remain halted for a pre-selected period of time, say, from about ½ second to about 5 seconds, or even more, if necessary, and then the movement of the sprocket wheel 61 and the sprocket chain 62 is automatically resumed and the entire operation continues.

Another detent or rod 69 is secured to the top side of the sprocket chain 62 and extends upwardly therefrom, as shown in FIGS. 2 and 11–14. It is to be appreciated that this upstanding rod 69 will cyclically move back and forth as the sprocket chain 62 carries it back and forth, with a momentary dwell at the extreme ends of such abck and forth movements, as the upstanding rod 69 changes direction of movement.

Figure 12:
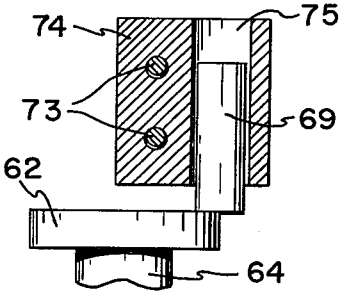
FIG. 12 is a fragmentary, cross-sectional view in elevation, taken on the line 12—12 of FIG. 11, looking in the direction of the arrows 12, 12, with some parts omitted for purposes of clarity of illustration.
Figure 13:
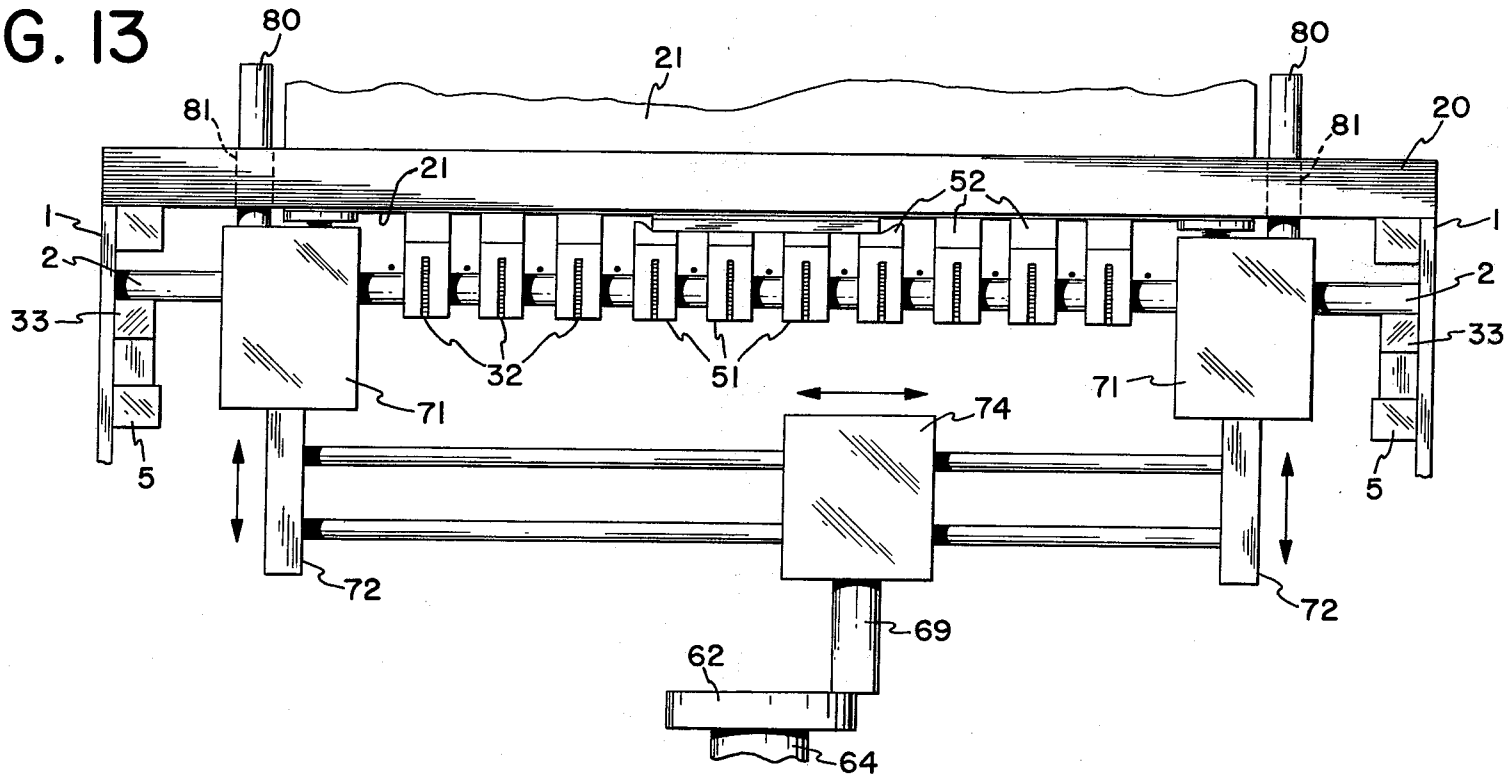
FIG. 13 is a fragmentary, cross-sectional view in elevation, similar to FIG. 11, taken at a different time in the operation of the present inventive concept.

Secured near the ends of the cam followers 2, 2 are a pair of blocks 71, 71 having vertically depending portions 72, 72 between which a pair of horizontally extending, cylindrically shaped rods 73, 73 are positioned. A centrally located sliding block 74 is mounted on the rods 73, 73 and is adapted to slide thereon laterally. The centrally located sliding block 74 is provided with a vertically-extending opening 75 into which the upstanding rod 69 slidably enters, as shown in FIG. 12.

As the sprocket chain 62 moves, the upstanding rod 69 moves with it and describes a corresponding geometric figure comprising two straight lines and two semicircles resembling a rectangle with semi-circles at the narrow ends thereof. The upstanding rod 69 which enters the opening 75 in the sliding block 74 causes the block 74 to have a similar back and fourth movement with a slight dwell at the ends thereof and to impart a similar movement to the shuttle assembly 25 and its associated parts, particularly the lifting and transporting members 32 which additionally have upward and downward movements. During such forward and rearward movement, the sliding block 74 also moves directly forwardly and rearwardly but also possesses a sidewise sliding movement on the sliding rods 73, 73 at the ends of the forward and rearward movements.

THE POWDER APPLYING STATION

The total intermittant forward step movement or stroke of the goods G by means of the lifting and transporting members 32 is, of course, less than the total movement or stroke of the cam followers 2, 2 inasmuch as the lifting and transporting members 32 are below the level of the support wires 14 for a brief portion at the beginning and the end of the operating stroke. It is only when the lifting and transporting members attain a level above the support wires 14 that the goods G are lifted and transported forwardly.

The total intermittant forward step movement of the goods G results in the goods G being moved forwardly to the left from their initial loading position, as placed there by an operator, or automatically if such type of feeding and loading device is used, to a second station $G_T$ whereat powdered, particulate, thermoplastic material T is applied to the upwardly-facing side of the goods G.

The goods G are positioned initially on the support wires 14 with their faces or insignia or other informative surfaces down, so that their backs or reverse surfaces are up and are adapted to receive the powdered, particulate, thermoplastic materials T.

As shown in FIGS. 1 and 2, a hopper 23 is provided to contain a supply of the powdered, particulate, thermoplastic material T and is located directly over the support wires 14 with enough clearance therebetween as to permit the lifting and transporting members 32 to carry the goods G thereunder and deposit them thereat, in position to receive the powdered, particulate, thermoplastic materials T.

The hopper 23 is provided with a bottom, floor, or base 27 having perforations or openings therein of a size suitable to permit the passage therethrough of the powdered, particulate, thermoplastic materials T at the desired, preselected moment during the cyclic operation. The floor 27 of the hopper 23 may be a suitably perforated sheet of metal, or plastic, or the like, having openings or holes drilled, punched, or otherwise formed therein, or it may be a woven screen having screen or sieve openings of the desired size. Also, the floor 27 may be flat or planar, or it may be corrugated to give it some additional strength.

The perforations or openings in the floor 27 of the hopper 23 will be described in greater detail herein with reference to a woven screen but it is to be appreciated that such description is equally applicable to the size and number of the perforations or other openings in other sheet materials of plastic, metal, or the like.

THE SCREEN

The screen 27 located at the bottom or floor of the hopper 23 possesses screen or sieve openings of such a size that substantially no portion of the finely divided, powdered, particulate thermoplastic materials T will pass therethrough, when the hopper 23 is stationary and motionless. However, if the hopper 23 is given a sudden, relatively violent vibratory or oscillatory motion, the particulate thermoplastic materials T will very rapidly pass through the openings in the screen 27 to fall upon any goods located thereunder.

The vibratory or oscillatory force is created by one or more conventional, commercially available vibrators 29 capable of producing a range of vibrations or oscillations of the hopper 23 of from about 30 cycles (back and forth movements) per second, up into the ultrasonic range, generally considered as greater than about 20,000 cycles per second. Normally, however, a range of from about 60 cycles per second to about 14,000 cycles per second has been found to be most desirable commercially.

The screen or sieve openings in the screen 27 located in the bottom or floor of the hopper 23 will also vary, depending to a very great extent upon the average particle size and the range of particle sizes of the particulate thermoplastic materials T. Normally, screens having a sieve opening of from about 250 microns (No. 60, U.S. Standard Sieve Series) to about 590 microns (No. 30, U.S. Standard Sieve Series) are commercially desirable and practical. Other screens having smaller or larger sieve openings, say, as small as about 210 microns (No. 70, U.S. Standard Sieve Series) or as large as about 2000 microns (No. 10 U.S. Standard Sieve Series) are also of use in special and unusual circumstances.

Additional details and further discussion regarding the relationship between the average particle size and the overall particle size range of the particulate thermoplastic materials T and the size of the screen or sieve openings of the screen 27 in the bottom or floor of the hopper 23 are to be found in my co-pending patent application, Ser. No. 673,719 which was filed on Apr. 5, 1976.

THE VIBRATOR

The vibrator (or vibrators) 29 is mounted on the hopper 23 as securely as possible, in a fashion consistent with the vibrational forces which are to be applied to the hopper 23. The vibrator 29 is intermittantly vibrated, in timed relationship and synchronization with the intermittant advancing movements of the goods, to vibrate the hopper 23, whereby the finely divided, powdered, particulate thermoplastic materials T pass through the screen or sieve openings to be deposited upon a particular applique, or patch, or the like.

When the vibrating motion of the hopper 23 ceases, no further particulate thermoplastic materials T pass through the screen or sieve openings, until the next particular applique, or patch, or the like, is moved underneath the hopper 23 and the hopper is vibrated again.

THE PARTICULATE THERMOPLASTIC MATERIALS

The particular chemical nature of the finely divided, powdered, particulate thermoplastic materials T in the hopper 23 does not relate to the essence of the present inventive concept but, preferably, such particulate thermoplastic materials T have a chemical nature that they possess relatively good potentially adhesive properties at relatively low softening or sticking temperatures, as well as relatively low melting or fusing temperatures.

The particulate thermoplastic materials T must, of course, be plastic or adhesively fusible at the normal operating temperatures of the present process, which temperatures must, of course, be low enough that the material which is to form the main body portion of the appliques, patches, or other goods not be undesirably affected or damaged.

Synthetic or man-made polymers, copolymers, or other resinous products are of use. These include: polyamides such as nylon 6, 6/6, 11, 12, 6/10 and copolymers thereof; cellulosic derivatives such as cellulose acetate and cellulose acetate butyrate; polyesters, such as polyethylene terephthalate; vinyl compounds including homopolymers, copolymers, and terpolymers derived from vinyl chloride, vinyl acetate, polyvinyl alcohol, etc.; homopolymers, copolymers, and terpolymers of acrylic and methacrylic acids and esters; polyurethanes; etc. Blends and mixtures of these polymeric materials and resins in varying proportions frequently yield very desirable properties and characteristics of excellent applicability to the present inventive concept.

The average particle size of the particulate thermoplastic materials T varies within relatively wide ranges, depending to a very large extent upon the size, thickness and the shape of the goods upon which they are to be deposited, the size of the openings of the screen 27 in the hopper 23; and so forth. Within the broader aspects of the present inventive concept, an average particle size of from about 0.1 micron to about 150 microns has been found practical, with preferred commercial limits for the average particle size ranging from about 5 microns to about 120 microns, and, most desirably, from about 20 microns to about 100 microns.

The amount of the particulate thermoplastic materials T which are applied to the goods may be varied within relatively wide limits depending upon the nature and type of the goods, the nature and type of the particulate thermoplastic materials, the purpose and subsequent use of the goods to which the particulate thermoplastic materials T are applied, and so forth. Under normal circumstances, from about 50 grams to about 300 grams per square yard are applied, with preferred commercial ranges extending from about 100 grams per square yard to about 200 grams per square yard. The specific amount applied to an individual piece of goods will depend, of course, upon its size or area.

The temperatures attained during the heating and bonding of the particulate thermoplastic materials T to the goods depend primarily upon the chemical and the physical properties and characteristics of the particulate thermoplastic materials T and, to a lesser extent, upon the nature of the goods to which they are applied and adhered. Under normal circumstances, the temperatures reached by the particulate thermoplastic materials T are in the range of from about 150° to about 600° F., and preferably in the range of from about 220° to about 460° F. The specific temperature selected for any particular process must be sufficient to soften and fuse the particulate thermoplastic materials T but not too elevated as to possibly damage the goods.

Any excess powdered materials T which do not fall on the goods G or remain thereon, fall between the spaced, relatively thin stationary support wires 14 and the relatively thin lifting and transporting members 32 and go into a collection hopper 40 to be collected for subsequent recycling and re-use. As noted in FIG. 2, the slanting and converging walls of the collection hopper 40 lead to a narrow mouth under which any desired receptacle or container (not shown) may be placed for easy collection of the unused thermoplastic materials T. As a consequence, there is substantially no loss of any powdered materials T and waste is cut to an absolute minimum, leading to enhanced efficiencies and economies.

After the powdered materials T have been deposited on the reverse side of the goods G, the next cycle commences immediately and another article is placed on the stationary wire supports 14 at the feeding or loading station and is advanced by the lifting and transporting members 32 to a position under the hopper 23. At the same time, a more forward portion of the lifting and transporting members 32 lifts the goods $G_T$ with the powdered materials T thereon from underneath the hopper 23 and moves the goods $G_T$ to the next advanced station or position underneath a heating and bonding station. Such a position is shown in FIG. 11.

THE HEATING AND BONDING OPERATION

At the heating and bonding station, the forward portions of the lifting and transporting members 32 are capped or provided with rectangular, inverted U-shaped presser elements or blocks 51, preferably made of metal or plastic, whereby, when the lifting and transporting members 32 are moved upwardly due to the cam action of the cam 33 on the cam followers 2, 2 to lift the goods $G_T$ from the stationary support wires 14, the goods $G_T$ are supported not on narrow, thin wires, such as the top surfaces of the thin lifting and transporting members 32, but by much wider presser elements 51. Additionally the goods $G_T$ will be lifted to a higher level inasmuch as the tops of the presser blocks 51 are higher than the tops of the members 32.

In FIG. 11, merely ten presser blocks 51 are shown, but it is to be realized that a larger number (or a smaller number) of such presser blocks 51 may be used whereby the intervening spaces between the presser blocks 51 may be smaller and merely sufficient to permit the passage of the stationary support wires 14 therebetween.

The upper surfaces of the presser blocks 51 are preferably covered with a firm, yielding but resilient material 52, such as a foamed or expanded material, sponge rubber, natural or synthetic rubber, synthetic elastomers, or like materials. This provides for a smoother and more even application of the heat and the pressure desired or required for the fusing and bonding operation.

A heating unit 20 is provided at the heating and bonding station and heat-resistant sheet material, such as a suitable release paper 21, delivered from a source of supply (not shown), or in the form of an endless sheet or belt, is positioned directly below the lower surface of the heating unit 20. Consideration of FIGS. 11 and 12 will establish that, when the goods $G_T$ are lifted and raised by the resilient tops 52 of the presser blocks 51, the top surface of the goods $G_T$ will be pressed directly against the release paper 21 and the bonding heat from the heating unit 20 will be transmitted to the powdered materials T through the intervening release paper 21. As a consequence, the powdered materials T are fused and bonded to the reverse sides of the goods $G_T$ which, in turn, are bonded to the release paper 21. Therefore, when the presser elements 51 are lowered due to the cam action of the cams 33 on the cam followers 2.2, the goods $G_T$ are not replaced on the stationary wires 14 but remain adhered to the under surface of the release paper 21, as shown at the left hand portion of FIG. 2.

THE RELEASE PAPER

The release paper 21 is normally prepared by applying a standard or conventional release agent coating composition substantially uniformly to the surface of paper or like sheet material. Silicone polymeric materials are normally preferred as the release coatings and may be sprayed, brushed, padded, or otherwise applied in any desired fashion and to any desired thickness of coating. Other suitable release agents applicable for use in the present inventive concept may be applied in the same way and include: fluorocarbon plastic materials such as polytetrafluoroethylene PTFE, fluorinated ethylene propylene FEP, etc.; natural and synthetic manufactured waxes; metallic salts of fatty acids, such as zinc stearate; soaps; polyvinyl alcohol; polyamides; polyethylene; polysiloxanes; "Quilon" Werner type chromium complexes in isopropanol; mica; talc; etc.

These release agents are applied substantially uniformly in standard or conventional amounts in order to provide the desired or required anti-stick, low-adhesion release properties and characteristics to the goods as applied to the release paper.

At the forward end of the shuttle assembly 25, a pair of vertically upstanding studs or rods 80 are vertically mounted on the blocks 71 and slidably project through vertically extending openings formed in the overhanging portion of the framework of the heating unit 20. As a consequence, whenever the shuttle assembly 25 is cyclically moved forwardly or rearwardly, due to the action of the driving and reversing mechanism of FIG. 14, the heating unit 20 will be correspondingly cyclically moved forwardly and rearwardly in synchronization therewith. However, since the studs or rods 80 of the shuttle assembly 25 slide vertically within the corresponding openings 81 of the heating unit 20, no vertical movement is imparted to the heating unit 20. Thus, the heating unit 20 will not receive any upward or downward movement, even though the lifting and transporting members 32 and the associated cam followers 2, 2 may be moving upwardly and downwardly cyclically. The heating unit 20 receives only forward and rearward movements from the rod 80.

Also, at the same time, as the shuttle assembly 25 moves upwardly from the position shown in FIG. 11 to the position shown in FIG. 12, a pair of spring-loaded T-shaped clamping heads 84 on each side of the heating unit 20 are slidably mounted in openings in the blocks 71 and also move upwardly to contact and clamp the release paper 21 against the lower surface of the heating unit 20 to prevent any relative movement or slippage between the two. As shown in FIG. 11, the T-shaped clamping head 84 is spring-loaded upwardly, urged thereby by a helical compression spring 83 surrounding the shaft 82 of the clamping head 84, which shaft 82 is slidably received in an opening in the block 71.

It is to be appreciated that the release paper 21 is not driven forwardly or pulled by any separate external driving force, such as a motor or the like, or is it mounted on a driving or constantly driven rotatable shaft. It is normally stationary or motionless but, when urged forwardly by means to be described hereinafter, may move forwardly a pre-selected or predetermined distance. However, when such forwardly-urging means is removed, the movement of the release paper 21 stops immediately.

The heating unit 20 may slide horizontally in upper and lower rails secured to the inside walls of the side plates 1, 1, in which case it will move in a level horizontal plane. However, if desired, the heating unit 20 may merely ride on a lower horizontal rail secured to the inside walls of the side plates 1,1. In such a case, the heating unit 20 will be maintained in a floating condition and may be raised slightly vertically off the lower rail when so urged by the clamping heads 84 and the upward thrust of the presser elements 51 and their resilient tops 52. As a result, the pressure exerted on the goods $G_T$ during the fusing and bonding operation is due to the weight of the heating unit 20 and therefore provides a constant loading factor.

Such a constant loading factor is, of course, desirable, particularly when goods are being processed which may have different thickness and which will receive different loading factors if the heating unit 20 were to be maintained in a constant horizontal plane at all times. With the floating heating unit 20, different thicknesses of goods $G_T$ are compensated for by the raising of the heating unit 20 to different levels or heights, whereby the loading factor is constant and is created only by the weight of the heating unit 20. Additionally, if increased or decreased pressures are desired, then additional weights may be placed on or removed from the heating unit 20 to provide additional or less loading.

During the forward movement of the shuttle assembly 25, the release paper 21, the goods $G_T$, and the heating unit 20, when they are pressed together at the elevated temperature of the heating unit 20, the goods $G_T$ are heated and the powdered thermoplastic materials T fused and bonded to the goods $G_T$. The temperature levels reached by the thermoplastic materials T are in the range of from about 150° to about 600° F. and preferably in the range of from about 220° to about 460° F., depending upon the particular powdered thermoplastic material used in the process.

At the end of the forward movement, the shuttle assembly 25 moves downwardly as the cam followers 2, 2 slide down the "down" cams but the heating unit 20, release paper 21 and the goods $G_T$ remain basically at the same height. The separation of the shuttle assembly 25 and the heating unit 20 causes the clamping heads 84 to move downwardly and to release their grip on the release paper 21.

When the shuttle assembly 25 and the heating unit 20 move rearwardly to start a new cycle, the release paper 21 with the goods $G_T$ adhered thereto is disengaged and separated from the shuttle assembly 25 and the heating unit 20 which move rearwardly. As a result, the release paper 21 and the freshly fused and bonded goods $G_T$ are positioned beyond the heating unit 20 and subsequently are moved beyond the heating unit 20 to a cooling station and subsequently on out of the operation. If desired, such as when an endless stretch or belt of release paper 21 is used to be returned and re-used again, the fused and bonded goods $G_T$ may be removed from the release paper 21 by a doctor blade or an equivalent device and dropped or directed to a receptacle or container positioned at the delivery end of the apparatus.

The time required for one complete cycle (including forward and rearward movements) depends upon many factors, primarily, the temperature of the heating unit and the nature, properties and characteristics of the powdered, particulate, thermoplastic materials, and more specifically, its particle size range and its softening and melt point characteristics.

Depending upon the above factors, and the degree of adhesion desired, complete cycles of as short as about one second are achievable in some circumstances, whereas complete cycles of as long as about twenty seconds are required in other instances.

In rare cases, such as in the use of relatively high melting point resins or high energy absorbing resins and in the use of goods which are heavy in weight and of considerable thickness, a complete cycle of as long as a minute or even longer are noted. However, such is not the usual situation or rule.

The present invention will be further described with particular reference to the following specific Examples, wherein there are disclosed typical and preferred embodiments of the present inventive concept. However, it is to be stated that such specific Examples are primarily illustrative of the present invention and are not to be construed as limitative of the broader aspects, except as defined and limited by the appended claims.

EXAMPLE I

The apparatus illustrated in FIGS. 1, 2, 9 and 11—14 is used in the Example. The goods are small, woven cotton fabric ovals which are intended to be adhered to shirts of employees, indicating their company affiliation. The ovals are approximately three inches by two inches (major and minor axes, respectively).

The powdered, particulate, thermoplastic material is BOSTIK 5132A specialty polyamide resin designed for use as a fusible textile adhesive. It has the following specifications:

| | |
|---|---|
| Type of resin | Polyamide resin |
| Melt Point (R & B) | 245° - 275° F. |
| Density | 1.095 grams per cc. |
| Particle size range | 0-80 microns (primarily 53-80 microns) |
| Bulk Density (unpacked) | 380-420 grams per liter |
| Bulk Density (packed) | 480-540 grams per liter |

-continued

| | |
|---|---|
| Moisture Content | Less than 3 percent by weight |

The length of the apparatus is about 22 inches and its width is about 6 and three-quarters inches. The total length of the stroke of the shuttle assembly is about seven inches and the forward movement of the goods, from the point it is picked up from the stationary support wires to the point where it is replaced on the stationary support wires, is about four and a half inches. The total length of the distance between the cam followers is about 11 and seven-eighths inches. Saw blades having serrated edges are used as the lifting and transporting members.

The floor of the hopper for the powdered, particulate, thermoplastic material is a flat perforated metal plate having very closely spaced openings (400 per square inch) having a diameter of 0.027 inches. The vibrator is a conventional, commercially available vibrator, 60 cycles, 110 volts, 2 amperes, and is securely attached to the hopper and causes the hopper to vibrate intermittantly and suddenly, in time and in synchronization with the intermittantly forwardly moved goods.

The release paper is in the form of an endless sheet material and is reused in the operation. It has a width of about 4½ inches and a total length of about 42 inches.

The temperature of the powdered, particulate, thermoplastic materials at the time of the fusing and bonding operation is approximately 275° F. The time required for one complete cycle is about 4 seconds (forward and backward movements). Such a cycle includes a two second dwell created by a suitable time delay device. The powdered, particulate, thermoplastic material is well adhered to the reverse surface of the cotton fabric oval which can easily be reheated and reactivated and permanently adhered to the shirt of the employee.

EXAMPLE II

The procedures set forth above are followed with the exception that the goods highly irregular, small monograms including several crossed tennis rackets and small openings. The overall measurements (longest length and longest width) are about three inches by three inches. The results are comparable to the results obtained with the cotton ovals previously described. The monogram with the thermoplastic materials adhered to the reverse side is easily applied to sports jackets and other articles of apparel by the addition of sufficient heat to reactivate the thermoplastic properties of the thermoplastic materials.

EXAMPLES III and IV

The procedures of Example I are followed substantially as described therein with the exception that the flat perforated metal plate in the hopper is replaced by a 40 mesh woven screen (Example III) and by a 50 mesh woven screen (Example IV) having sieve openings of 420 microns and 297 microns, respectively. The results are generally comparable to the results of Example I.

EXAMPLE V and VI

The procedures of Example I are followed substantially as described therein with the exception that the cam which is used to give the cam follower and the shuttle assembly the desired upward, horizontal, downward, and rearward movements are illustrated in FIGS. 3 - 8 (Example V) and FIG. 10 (Example VI). The results obtained in these Examples are generally comparable to the results obtained in Example I. The product is substantially equally commercially acceptable.

Although several specific Examples of the inventive concept have been described in particularity, the same should not be construed as limiting the invention to the specific materials and procedures mentioned therein but to include various other materials and procedures, as well as other equivalent features, as set forth in the claims appended hereto. It is understood that any suitable changes, modifications, and variations may be made without departing from the scope and the spirit of the broader aspects of the invention.

What is claimed is:

1. Apparatus for applying and adhering particulate thermoplastic materials to supporting substrates, such as medallions, appliques, patches and like goods which comprise: a relatively stationary support; means for placing the goods on said relatively stationary support at a loading station thereof; intermittantly operable transporting means for lifting said goods from said relatively stationary support, moving said goods forwardly by step-by-step stages from said loading station, and replacing said goods on said relatively stationary support at a particulate thermoplastic materials applying station thereof; intermittantly operable means for applying particulate thermoplastic materials to the surface of said goods while said goods are stationary at said particulate thermoplastic materials applying station; intermittantly operable transporting means for lifting said goods with the applied particulate thermoplastic materials thereon from said relatively stationary support, moving said goods forwardly by step-by-step stages from said particulate thermoplastic materials applying station, and replacing said goods on said relatively stationary support at a heating, pressure-applying and bonding station thereof; intermittantly operable means for heating and applying pressure to said particulate thermoplastic materials and adheringly bonding the same to the surface of said goods; and means for disengaging or separating said goods with said adhered thermoplastic materials thereon from said relatively stationary support so that said goods are positioned forwardly beyond said heating, pressure-applying and bonding station.

2. Apparatus as defined in claim 1, wherein said relatively stationary support comprises a plurality of stationary, relatively parallel wires or thin rods which are spaced sufficiently close together as to be capaple of supporting said goods.

3. Apparatus as defined in claim 1, wherein said transporting means for lifting said goods from said relatively stationary support comprises a plurality of movable, relatively parallel wires of thin rods which are spaced sufficiently close together as to be capable of picking up, supporting, and moving said goods.

4. Apparatus as defined in claim 1, wherein said relatively stationary support comprises a plurality of stationary, relatively parallel wires or thin rods and said transporting means comprises a plurality of movable, relatively parallel wires or thin rods which are capable of interdigitating or moving between said plurality of stationary relatively parallel wires or thin rods.

5. Apparatus as defined in claim 3, wherein the top surfaces of said plurality of movable, relatively parallel wires or thin rods are roughened or serrated.

6. Apparatus as defined in claim 3, wherein the plurality of movable, relatively parallel wires or thin rods of said transporting means are capable of a cyclic upward, forward, downward, and rearward movement.

7. Apparatus as defined in claim 1, wherein cam and cam follower means are provided to enable said transporting means to lift said goods from said relatively stationary support, move said goods forwardly, and subsequently replace said goods on said relatively stationary support.

8. Apparatus as defined in claim 7, wherein said cam possesses a slanting upwardly inclined surface, a substantially horizontal surface, and a slanting downwardly inclined surface.

9. Apparatus as defined in claim 1, wherein said disengaging or separating means comprises sheet material to which said goods are adhered.

10. Apparatus as defined in claim 9, wherein said sheet material is release paper.

11. Apparatus as defined in claim 9, wherein means are provided to press said goods with said particulate thermoplastic materials thereon against said release paper.

12. Apparatus for applying and adhering particulate thermoplastic materials to supporting substrates, as defined in claim 1, wherein said intermittantly operable means for applying particulate thermoplastic materials to the surface of said goods comprises: a hopper for containing a supply of said particulate thermoplastic materials; a floor in said hopper having openings therein of a size such that no particulate thermoplastic materials pass therethrough when said hopper is stationary; and intermittantly operable vibrating means for vibrating said hopper, whereby said particulate thermoplastic materials pass through said openings during such vibrating of said hopper.

13. Apparatus for applying and adhering particulate thermoplastic materials to supporting substrates, as defined in claim 12, wherein means are provided to synchronize said intermittantly operable vibrating means with said intermittantly operable transporting means, whereby said hopper is vibrated only when said intermittantly operable transporting means is inoperable and said goods are stationary.

14. Apparatus for applying and adhering particulate thermoplastic materials to supporting substrates, as defined in claim 12, wherein said hopper has openings of from about 210 microns to about 2000 microns.

15. Apparatus for applying and adhering particulate thermoplastic materials to supporting substrates, as defined in claim 12, wherein said hopper has openings of from about 250 microns to about 590 microns.

16. Apparatus for applying and adhering particulate thermoplastic materials to supporting substrates, as defined in claim 1, wherein said heating means is intermittantly movable in synchronization with the intermittant movement of said goods.

17. Apparatus for applying and adhering particulate thermoplastic materials to supporting substrates, as defined in claim 16, wherein means are provided to synchronize said intermittantly movable means for heating said particulate thermoplastic materials with said intermittantly operable transporting means, whereby said intermittantly movable means for heating said particulate thermoplastic materials heats said particulate thermoplastic materials only when said transporting means is operable and said goods are being transported.

18. Apparatus for applying and adhering particulate thermoplastic materials to supporting substrates, as defined in claim 1, wherein said means for heating said particulate thermoplastic materials is a floating means and applies pressure to said goods due to its own weight.

19. Apparatus for applying and adhering particulate thermoplastic materials to supporting substrates, as defined in claim 18, wherein weights may be employed in conjunction with said floating heating means to vary the pressure applied to said goods.

* * * * *